United States Patent [19]

Pierson

[11] Patent Number: 4,987,932

[45] Date of Patent: Jan. 29, 1991

[54] PROCESS AND APPARATUS FOR RAPIDLY FILLING A PRESSURE VESSEL WITH GAS

[76] Inventor: Robert M. Pierson, 44 E. Boston Mills Rd., Hudson, Ohio 44236

[21] Appl. No.: 416,028

[22] Filed: Oct. 2, 1989

[51] Int. Cl.[5] ..... F17C 7/02; B65B 31/00

[52] U.S. Cl. ..... 141/001; 141/4; 141/5; 141/11; 141/18; 141/82; 62/50.001; 62/50.1; 48/190; 62/55.5

[58] Field of Search ..... 141/1, 2, 4, 5, 11, 141/18, 82; 45/190, 197 R; 62/50.1, 50.2, 50.3, 50.7, 45.1, 55, 56

[56] References Cited

U.S. PATENT DOCUMENTS

| | | | |
|---|---|---|---|
| 1,196,643 | 8/1916 | Bedford et al. . | |
| 2,304,488 | 12/1942 | Tucker . | |
| 2,443,724 | 6/1948 | Cibulka . | |
| 2,541,569 | 2/1951 | Born et al. . | |
| 2,574,177 | 11/1951 | Godet . | |
| 2,609,282 | 9/1952 | Haug et al. . | |
| 2,636,814 | 4/1953 | Armstrong et al. . | |
| 2,645,906 | 7/1953 | Ryan . | |
| 2,701,133 | 2/1955 | Mendez . | |
| 2,745,727 | 5/1956 | Holzapfel . | |
| 2,940,268 | 6/1960 | Morrison . | |
| 3,232,725 | 2/1966 | Secord et al. | 48/190 |
| 3,298,805 | 1/1967 | Secord et al. | 48/190 |
| 3,548,607 | 12/1970 | Pillsbury, Jr. et al. | 62/50.1 |
| 3,565,201 | 2/1971 | Petsinger . | |
| 3,689,237 | 9/1972 | Stark et al. . | |
| 3,713,794 | 1/1973 | Maher et al. . | |
| 3,788,825 | 1/1974 | Arenson . | |
| 3,827,247 | 8/1974 | Kojima et al. . | |
| 3,885,394 | 5/1975 | Witt et al. . | |
| 3,898,853 | 8/1975 | Iung . | |
| 3,950,958 | 4/1976 | Loofbourow . | |
| 4,153,083 | 5/1979 | Imler et al. | 141/4 |
| 4,336,689 | 6/1982 | Davis | 62/50.1 |
| 4,351,372 | 9/1982 | Delgado, Jr. | 141/2 |
| 4,406,129 | 9/1983 | Mills | 62/7 |
| 4,475,348 | 10/1984 | Remes | 62/55 |
| 4,887,857 | 12/1989 | Van Ommeren | 141/1 |

*Primary Examiner*—Ernest G. Cusick
*Attorney, Agent, or Firm*—Paul E. Milliken

[57] ABSTRACT

A process and apparatus for rapidly filling a pressure vessel such as a fuel storage tank with highly pressurized gas by initially inserting into the tank, a measured quantity of liquefied natural gas (LNG) or some other type of cryogenic liquid and permitting the temperature of the liquid to rise within the tank to vaporize it into a gas under a pressure which at least approaches the design working pressure of the tank. The storage tank maintains the gas under sufficiently high pressure that automotive fuel tanks or other small tanks can be rapidly filled from the storage tank without compressors due to the high internal pressure of the storage tank.

9 Claims, 2 Drawing Sheets

PROCESS AND APPARATUS FOR RAPIDLY FILLING A PRESSURE VESSEL WITH GAS

This invention relates to a process and apparatus for rapidly filling a pressure vessel such as a fuel storage tank with highly pressurized gas by initially inserting into the tank liquefied natural gas or other cryogenic liquid and permitting the temperature of the gas to rise in the tank and vaporize the liquid to a gas at a pressure which at least approaches the design operating pressure of the tank.

BACKGROUND OF THE INVENTION

Natural gas usage in automotive vehicles is rapidly increasing throughout the world, both because of its operating and cost advantages over gasoline and diesel fuel and because the air pollution problems produced by the latter fuels have become so acute, particularly in urban areas, that national and local governments are requiring vehicle manufacturers and fuel suppliers to intensify their efforts to enable vehicles to operate on alternate fuels. There are over 30,000 automobiles, trucks and buses operating on natural gas in the United States and about twenty times that number operating worldwide. Such vehicles draw their gas from heavy-walled high pressure cylinders (usually steel) secured to the vehicles' frames.

In order to contain sufficient gas to enable a reasonable range of operation for the vehicle, such cylinders are typically charged to an initial pressure of 2,000 to 3,000 psi. Since local gas distribution lines typically operate in the range of 100 to 150 psi, fueling stations must be built with sufficient compression capacity to charge the gas at the required high pressures and to fill the vehicles' tanks through high-pressure lines. Usually, such fueling stations are built to supply fleets of a specific number of vehicles and are sized for a known average fuel consumption per day. Because the costs of building the stations are almost directly proportional to the rate at which the vehicles must be filled, station owners are faced with a choice between the prohibitively high costs of a large compressor to achieve the same rapid filling rates (usually a few minutes) which are attained with filling gasoline or diesel fuel tanks, or with putting in a much smaller, but still very expensive, compressor systems that achieve the necessary pressures and delivered volumes over a 12 to 18 hour period.

Practically all systems in use are of the latter type, and require that a majority of the vehicles be tethered to gas feed lines overnight, while the compressors slowly build up pressure in the tanks. The types of fleets so supplied are those limited to day-time or single shift use in local service. The vehicle-mounted tanks are usually sized to permit ranges of about 75 to 125 miles (121 to 202 km) without refill. The high capital costs and slow-fill limitations have severely hampered the growth of fleet usage of compressed natural gas for vehicles. A further handicap is the high electrical energy cost for operating the compressors.

Most users are unwilling to have their vehicles tied up overnight to fill the gas tanks, and the alternative of installing compressors large enough to fill the tanks in 5 to 10 minutes is so expensive that it is impractical and there are essentially no "quick fill" stations of this type.

U.S. Pat. No. 2,574,177 issued to R. Godet shows the use of automotive vehicle wheel or motor to drive a compressor to pressurize the gas in the fuel tank; however, this method has the same problem as the compressors previously mentioned in that it takes too long to build up a sufficient amount of pressure and most vehicles cannot be tied up for that length of time.

OBJECTS OF THE INVENTION

It is a primary object of this invention to provide a simple and inexpensive batch process and apparatus for rapidly filling a high pressure gas storage tank from which gas fuel tanks for automotive vehicles may be rapidly filled.

Another object of this invention is to eliminate the need for using large expensive compressors to build up the necessary pressure in a gas storage tank.

A still further object of this invention is to make it economically feasible to provide a sufficient number of fuel gas dispensing stations for automotive vehicles so that widespread use of pressurized natural gas will be adopted as an alternative to gasoline and diesel fuel, thereby greatly reducing the air pollution caused by the use of such liquid fuels.

These and other objects of the invention will become more fully apparent in the following specification and the attached drawings.

SUMMARY OF INVENTION

This invention is a process and apparatus for rapidly filling a pressure vessel such as a high pressure fuel tank by providing a liquid source of cryogenic liquid at a temperature below −150° F., (−101° C.) a pressure vessel of a predetermined internal volume which is capable of a design working pressure of at least 500 psi (35.2 kg/cm$^2$) with a conduit connecting the liquid source to the interior of the pressure vessel, and transferring from the liquid source to the pressure vessel, a sufficient amount of the cryogenic liquid that when such liquid reaches at least 0° F. (−17.8° C.), within the pressure vessel, it will convert to a gas under a pressure which at least approaches the design working pressure of said pressure vessel.

DESCRIPTION OF THE PREFERRED EMBODIMENTS

Figure 1:
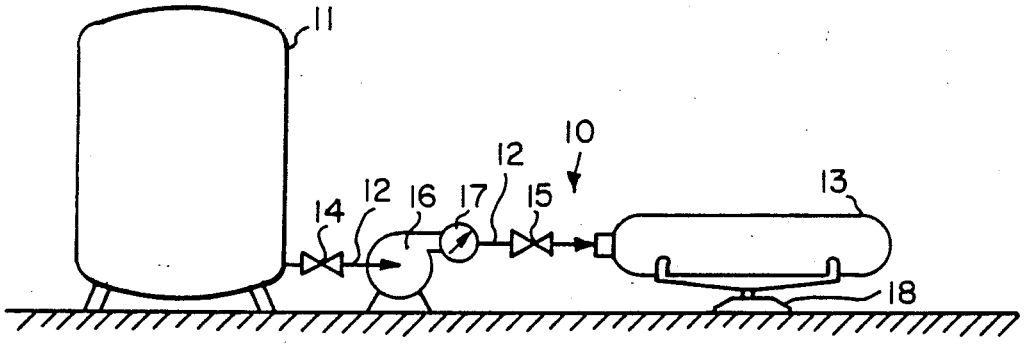
FIG. 1 is a diagrammatic view of one embodiment of the invention.

Referring now to the drawings and in particular to FIG. 1, a system for carrying out the present invention is generally designated by the numeral 10. The system basically comprises an insulated reservoir 11 for containing liquefied natural gas (hereinafter referred to as "LNG").

An insulated conduit 12 is connected between the outlet of the reservoir 11 and the inlet of a tank 13 to be filled with gas. A control valve 14 is connected between the conduit 12 and the outlet of the reservoir 11. Another control valve 15 is connected between the conduit 12 and the inlet of the tank 13.

A small pump 16 having a meter 17 for measuring the volume of LNG transmitted by the pump is operatively connected into the conduit 12 between the reservoir 11 and the tank 13. A weigh scale 18 may be optionally used beneath the tank 13 to confirm the readings of the meter 17, or may serve as the primary measure of LNG added, rather than the meter 17. The tank 13 can be filled with LNG in either a vertical or horizontal position. If mounted on a vehicle it would ordinarily be horizontal.

In operation of the invention using the system shown in the embodiment of FIG. 1, a precisely controlled amount of LNG is pumped by the pump 16 from the reservoir 11 through conduit 12 to the tank 13. The tank 13 is a heavy walled pressure vessel of a known volume and which is designed to carry an internal pressure in the range of 2,000 to 3,000 psi (140 to 210 kg/cm$^2$).

LNG is a cryogenic liquid which can exist only at very low temperatures and cannot be liquefied by merely pressurizing the material to very high pressures at ambient temperatures. Natural gas (predominantly methane) does not have a critical pressure at ambient temperatures, but achieves critical pressures at temperatures so low that, for practical purposes, it is usually liquefied at temperatures at or below its boiling point at atmospheric pressure, which is −263° F. (−161.5° C.) or less. The specific gravity of LNG is 0.42 which corresponds to a density of 3.6 pounds per gallon 0.416 kg/l.

Operation of the invention relies upon computations based on gas laws, the most fundamental of which relates pressure (P), volume (V), temperature (T) and amount of gas in mols (N) as used in the equation PV=NRT, where R is a constant which applies to all gases. Using English units for temperature (degrees Rankine), volume (cubic feet) and pressure in atmospheres (absolute), it is only necessary for present purposes to utilize the value derived from this equation which tells us that one pound-mol of natural gas 16 lbs (7 kg) occupies 359 cu ft (10.16 l) at a standard temperature of 32° F. (0° C.), (273° K.) (492° R) and a pressure of one atmosphere, 14.5 psi (1.02 kg/cm$^2$). From the use of this formula, simple relationships between pressure and volume of any given amount of gas can be derived.

Therefore, in order to utilize the system illustrated in FIG. 1, one can by using the previously described formula calculate the amount of LNG which must be transferred from the reservoir 11 to the gas tank 13 to provide a specified amount of gas at a desired pressure when the interior of the tank is at a certain temperature.

For example, a mol of natural gas, weighing 16 lbs (7 kg) (neglecting the small amounts of higher molecular weight components) will occupy 2.38 cu ft (67.5 l), at 150 atmospheres absolute (2,200 psi (150 kg/cm$^2$) absolute), which is a typical pressure for a vehicle tank. From this it follows that a 6.0 cu ft (169.5 l) tank (a typical size used on buses) would accommodate 40.4 lbs (18 kg) of natural gas at the design pressure of 2,200 psi (150 kg/cm$^2$) absolute. The amount of LNG to be injected into the tank 13 is therefore, 11.3 gallons (43 l), or 1.52 cu ft.

In the foregoing example the tank being filled contains no residual gas and therefore is at ambient pressure. In many instances the tank to be filled will contain some residual gas from a previous filling and, therefore, will contain some pressure above ambient. In such instance the amount of LNG required to re-pressure the tank to its design pressure when full of gas may be calculated from the following equation:

$$W = \left(\frac{P_d - P_g}{P_d}\right)40.4 \text{ lbs} = \left(\frac{P_d - P_g}{P_d}\right)17.6 \text{ kg}$$

where $P_d$ is design pressure, $P_g$ is gauge pressure (in atmospheres) and W is the weight of LNG to be introduced into the tank. Thus, if the gauge pressure were 14 atmospheres (205 psi (14.5 kg/cm$^2$)), the amount of LNG needed in the 6.0 cu ft (169.5 l) tank of the foregoing example would be 38.1 lbs (16.6 kg) or 10.3 gallons (39 l), rather than the 11.3 gallons (42.8 l) that would required to sufficiently pressurize a substantially empty tank.

Figure 2:
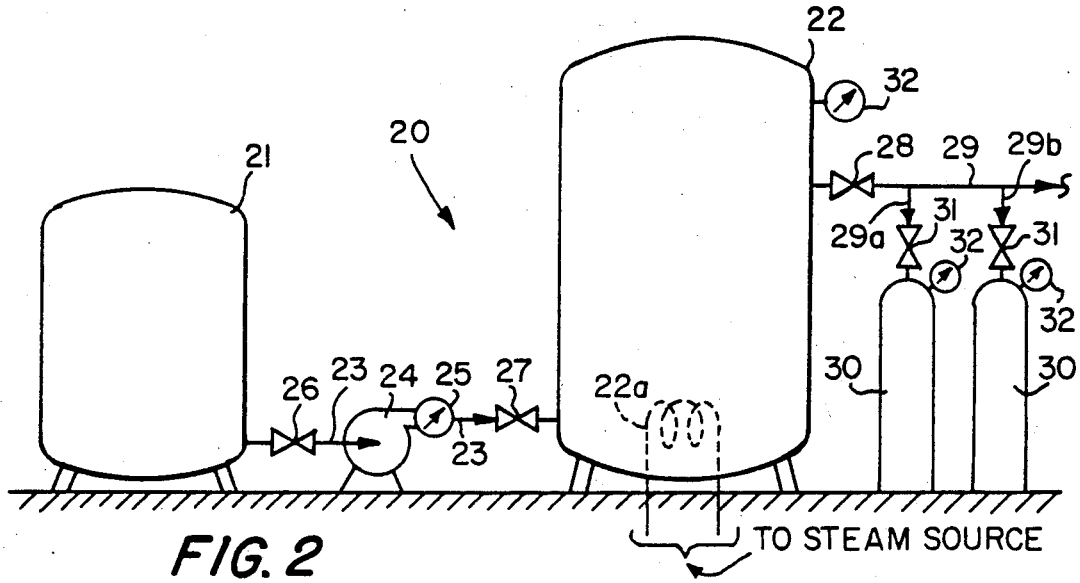
FIG. 2 is a diagrammatic view of another embodiment of the invention.

In the embodiment shown in FIG. 2, the overall fuel system is indicated by the numeral 20. The system 20 contains a reservoir 21 for storing LNG for transfer to a large bulk supply tank 22 through an insulated conduit 23. Connected into the conduit 23 is a pump 24 having a meter 25 for measuring the amount of LNG pumped through the conduit 23. Also connected into the conduit is a valve 26 near the outlet of the reservoir 21 and a similar valve 27 near the inlet of the tank 22. A valve 28 is positioned at the outlet of the tank 22 to control the flow of gas to a main service line 29 from which extends a plurality of branch service lines **29*a*, 29*b* and others (not shown) which are respectively connected a plurality of vehicle fuel tanks 30 through a valve 31 which is located at each tank inlet. Each of the fuel tanks is equipped with a pressure gauge 32. The bulk storage tank 22 is also equipped with a pressure gauge 33 to measure the pressure within the tank. When charging the bulk tank 22 with LNG, if desired, the vaporization of the LNG can be accelerated by applying to the tank, a suitable heating means, such as a coil heater 22*a* mounted inside the tank 22** and connected to a steam or hot water source (not shown).

In many operational situations, the concept shown in FIG. 2, of filling a large bulk storage tank with LNG which is vaporized into gas is preferable to inserting LNG directly into the vehicle fuel tank and permitting it to vaporize in the fuel tank.

As an example of the concept shown in FIG. 2, a 100 cu ft (2,830 l) tank with a design operating pressure of 4,500 psi (316 kg/cm$^2$) absolute (305 atmospheres) would hold 1,380 lbs (602 kg) of compressed gas, would be initially charged with 37.8 gallons (14.3 l) of LNG and would be capable of charging at least 12 vehicle fuel tanks such as the tanks 30 having a capacity of 6.0 cu ft (169.5 l) when empty, assuming the pressure in the bulk tank 22 was drawn down to the 2,200 psi (150 kg/cm$^2$) pressure of the vehicle fuel tanks. It would however, be impractical to draw down the pressure of the bulk tank to such a low pressure, because the rate of filling the vehicle tanks decreases rapidly when the bulk tank pressure drops so low.

When filling the vehicle tanks 30 it is not necessary to accurately measure the volume of gas fed to each tank since the pressure gauge 32 for each tank would normally determine the shut-off pressure, and the flow of gas into the vehicle tank could be automatically shut off by a pressure sensitive device (not shown). Since the gas temperature changes as it expands on reaching the lower pressure in the vehicle tank, it is necessary to compensate for this temperature change when determining the shut-off pressure of the vehicle tank.

Figure 3:
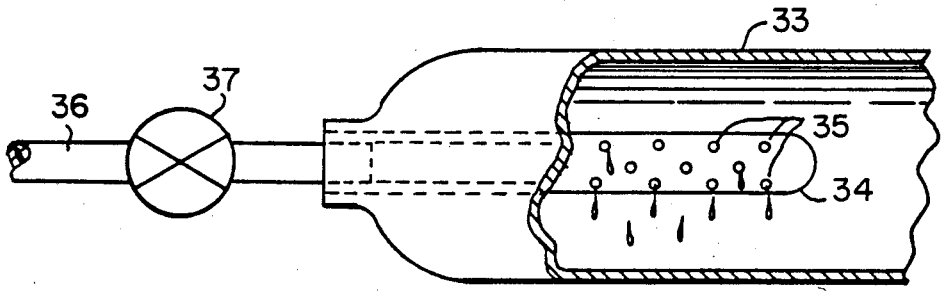
FIG. 3 is a fragmentary side elevational view, partially in section, of still another embodiment of the invention.

Referring now to the embodiment of FIG. 3, the numeral 33 indicates a tank similar to the tank 13 in FIG. 1 or the tank 22 in FIG. 2. The tank 33 is fitted with a cylindrical perforate thin walled insert 34 of aluminum or other suitable material which extends from the tank inlet to the interior of the tank. The insert preferably occupies a volume of no more than 25% of the internal volume of the tank 33. The walls of the insert 34 contain a plurality of small pin hole perforations 35 which permit LNG to slowly seep from the interior of the insert 34 to the interior of the tank 33 surrounding the insert. In operation, LNG is pumped from a source such as the tank 11 in FIG. 1 through an insulated conduit 36, through valve 37 and into the insert 34. The valve 37 is closed and the LNG dribbles into the interior of the tank 33 surrounding the insert 34 where it contacts the walls of the tank 33 and vaporizes due to the temperature of the tank walls.

Thus it can be seen that the insert 34 impedes exposure of the LNG to the tank walls and therefor slows down the cooling of the tank walls and the rate at which the internal pressure builds up within the tank 33. The use of aluminum inserts such as that described herein enables the use of low cost steel tank walls without the concern for the tendency of the steel to develop cracks from the rapid cooling when contacted directly by a large volume of cryogenic liquid. Since steel tanks are both less expensive and stronger than aluminum tanks, use of inserts as cryogenic liquid receiving chambers or "ante chambers" will improve the economics and operational efficiencies of fueling stations by permitting the use of steel tanks.

Figure 4:
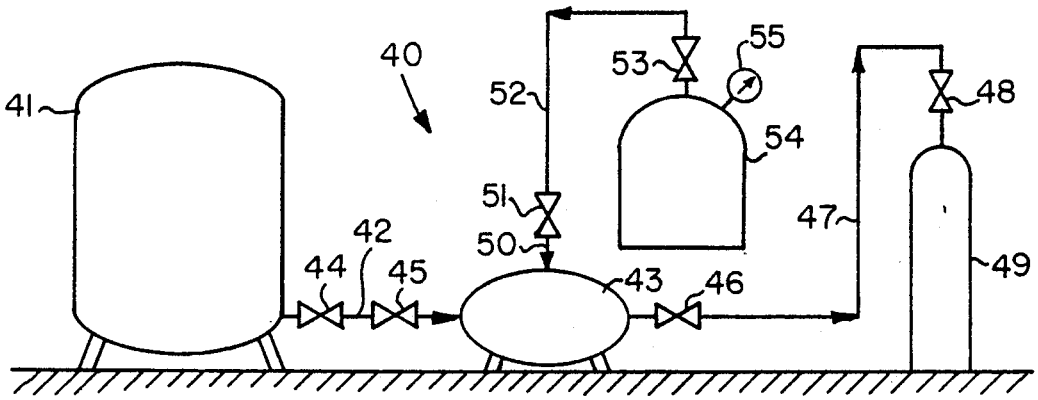
FIG. 4 is a diagrammatic view of an even further embodiment of the invention.

Referring now to the embodiment of FIG. 4, another system for carrying out the invention is indicated generally by the numeral 40. The system 40 comprises an insulated supply tank or reservoir 41 for containing LNG. An insulated conduit 42 is connected between the outlet of the reservoir 41 and the inlet of an insulated high pressure charging tank 43. A control valve 44 is connected between the conduit 42 and the outlet of the reservoir 41. Another control valve 45 is connected between the conduit 42 and the inlet of the charging tank 43.

The outlet of the charging tank 43 is connected through a valve 46 which in turn is connected to an insulated conduit 47 which connects through a valve 48 to the inlet of the gas storage tank 49 which may in some instances be a fuel tank of a vehicle.

The charging tank 43 has a pressure inlet 50 located at the top of the tank in communication with the vapor space at the upper interior of the tank. The inlet 50 is connected through a valve 51, a conduit 52 and then through another valve 53 to a pressurizing tank 54 having a pressure gauge 55.

The pressurizing tank 54 will preferably have the capability of carrying a pressure of over 1,000 psi (70.3 kg/cm$^2$), which should be sufficient pressure to rapidly drive LNG from the charging tank 43 into the gas tank 49 as will be explained later in further detail.

The insulated charging tank 43 selected for use in each situation is of a specific size which is large enough to hold the correct measured amount of LNG which will be needed to fill the particular size of tank 49 being charged with LNG to be vaporized. Different sizes of charging tanks (for example 1, 4 and 10 gallons (3.79, 15.2 and 37.9 l) or other sizes) may be retained on hand to satisfy the requirements of filling different sizes of empty or partially empty fuel tanks In operation, when a gas tank such as the tank 49 is to be filled, the valves 44 and 45 are opened allowing LNG to flow by gravity or with low pressure assistance from the LNG supply tank or reservoir 41 through the insulated conduit 42 into the charging tank 43. When the tank 43 is full, except for a small vapor space at the top, the valves 44 and 45 are turned off. The valves 46 and 48 are opened and at approximately the same time the valves 51 and 53 are opened to permit the high pressure gas within the pressurizing tank 54 to pass through the high pressure line 52 and into the vapor space at the top of the tank 43 and drive the LNG out of the tank 43 through the insulated conduit 47 into the gas tank 49. When the tank 49 has received a sufficient amount of LNG, the valves 46, 48, 51 and 53 are all closed and the necessary pressure is then permitted to build up in the tank 49 due to the warming of the LNG. The tank 49 can then be disconnected and replaced with another empty tank and the process can then be repeated.

While the embodiments shown in FIGS. 1 through 4 have been described in conjunction with the use of LNG, the concepts and apparatus described previously can also be applied to other cryogenic gases such as liquefied nitrogen and oxygen. Practically all commercial uses of these two gases are based on their separation from air which is first liquefied cryogenically, allowing them to be separated by fractional distillation. Thus, such gases must go through the liquefied state as an unavoidable step in the process of their eventual use in the gaseous form. Many gases are supplied from high pressure steel tanks requiring the liquefied nitrogen or oxygen to be first gassified by heating and then compressed to the high pressures (usually over 2,000 psi (140 kg/cm$^2$)) required before shipping the tanks to the customer. Reducing the investment and operating costs of tank filling stations would have the same attractions to owners of such stations as it would for the owners of LNG fueling stations.

If the example used in connection with filling the 6.0 cu ft (169.5 l) tank 13 shown in FIG. 1, instead of being applied to LNG, were to be applied to liquefied nitrogen having the properties of boiling point = −321° F. (196.1° C.), specific gravity at boiling point = 0.808, corresponding to a density of 6.8 lbs per gallon (0.785 kg/l), then the amount of liquefied nitrogen to be admitted to the tank would be 69.8 lbs (30.4 kg), or 10.2 gallons (38.5 l), in order to build up to the design pressure of 2,200 psi (150 kg/cm$^2$) when warmed to ambient temperatures.

A similar computation can be made for liquefied oxygen which has a boiling point at atmospheric pressure of −297° F. (−182.8° C.) and specific gravity of 1.14. It is further evident that the use of large high pressure bulk tanks as described in FIG. 2 and the use of thin walled perforate inserts or "ante-chambers" as described in FIG. 3 for use with LNG, would also be applicable to liquefied nitrogen, oxygen or other cryogenic gases.

While the examples cited herein are calculated for specific conditions of pressure, volume, amount of gas and assumed temperature ("ambient") in each case, it is within the scope of this invention that amounts of gas charged in actual operating conditions will be adjusted for such factors as the expected temperature range where the high pressure cylinder is to be used, permissible safety factor for the cylinders being used and the like. Thus, a cylinder charged to read 2,200 psi (150 kg/cm$^2$) in a cold 0° F. (−17.8° C.) environment may quickly reach a substantially higher pressure if mounted near the vehicle's exhaust system. Accordingly, normal practice would be to charge the maximum amount of gas permissible, consistent with safety factors of the equipment, expected temperature environment, and other service conditions that may be encountered.

These and various other modifications can be made herein without departing from the scope of the invention.

I claim:

1. A process for rapidly filling a pressure vessel with highly pressurized gas comprising the steps of:

(A) providing a liquid source containing cryogenic liquid at a temperature below −150° F. (101° C.);

(B) providing a pressure vessel of a predetermined internal volume which is capable of a design working pressure of between 500 psi (35.2 kg/cm$^2$) and 4,000 psi (280 kg/cm$^2$);

(C) providing a conduit connecting the liquid source to the interior of the pressure vessel; and (D) transferring from the liquid source to the pressure vessel, a sufficient amount of the cryogenic liquid that when such liquid reaches at least 0° F. (−17.8° C.), within the pressure vessel, it will convert to a gas under a pressure of at least 50% of the design working pressure of said pressure vessel.

2. The process as claimed in claim 1 wherein the gas is comprised of at least 80% methane.

3. The process as claimed in claim 1 wherein the gas is selected from the group consisting of nitrogen and oxygen.

4. The process as claimed in claim 1 wherein the cryogenic liquid is any substance capable of existing in the liquid state at a temperature below −150° F. (−101° C.), and at a pressure at least as high as atmospheric.

5. The process as claimed in claim 1 including the step of transferring at least part of the gas in the pressure vessel to at least one tank which is smaller in volume and has a substantially lower design working pressure than the pressure vessel, such transfer of gas being made after the gas within the pressure vessel has reached a temperature of at least 0° F. (−17.8° C.) and a pressure equivalent to the design working pressure of the pressure vessel.

6. The process as claimed in claim 1 including the steps of:

(A) providing a perforate walled insert defining a chamber within the pressure vessel, said insert occupying a volume of no greater than 25% of the volume of the pressure vessel;

(B) connecting the conduit from the liquid source to the chamber of the insert; and (C) transferring the cryogenic liquid through the conduit into the chamber whereby the liquid slowly drains from the chamber into the portion of the interior of the pressure vessel which surrounds the chamber.

7. The process as claimed in claim 1 wherein the amount of cryogenic liquid to be transferred to the pressure vessel is determined by the equation: $PV=NRT$ where $P$=pressure, $V$=volume, $T$=temperature, $N$=amount of gas in mols and $R$=a constant which applies to all gases.

8. The process as claimed in claim 1 including the steps of:

(A) providing a high pressure charging tank operatively connected into the conduit between the liquid source and the pressure vessel;

(B) providing a pressure source connected in communication with the interior of the charging tank;

(C) transferring the cryogenic liquid from the liquid source to the charging tank;

(D) closing off the charging tank from the liquid source; and (E) introducing pressure from the pressure source into the charging tank to cause the cryogenic liquid to flow from the charging tank into the pressure vessel to be charged with pressurized gas.

9. The process as claimed in claim 1 including the step of applying a heating means to the pressure vessel to accelerate the conversion of the cryogenic liquid to a pressurized gas within the pressure vessel.

* * * * *